US008695284B2

(12) United States Patent
Ho

(10) Patent No.: US 8,695,284 B2
(45) Date of Patent: Apr. 15, 2014

(54) EXTENDABLE BACKDROP ERECTING DEVICE

(71) Applicant: Tai-Yi Ho, Taipei (TW)

(72) Inventor: Tai-Yi Ho, Taipei (TW)

( * ) Notice: Subject to any disclaimer, the term of this patent is extended or adjusted under 35 U.S.C. 154(b) by 0 days.

(21) Appl. No.: 13/657,889

(22) Filed: Oct. 23, 2012

(65) Prior Publication Data

US 2013/0139449 A1 Jun. 6, 2013

(30) Foreign Application Priority Data

Dec. 2, 2011 (TW) ..... 100144338 A

(51) Int. Cl.
*E04B 1/346* (2006.01)
*E04H 5/00* (2006.01)

(52) U.S. Cl.
USPC ..... 52/64; 52/79.5

(58) Field of Classification Search
USPC ..... 52/64, 70, 71, 79.5, 632, 745.15, 52/745.11, 6; 160/206
See application file for complete search history.

(56) References Cited

U.S. PATENT DOCUMENTS 1,100,273 A * 6/1914 Wiard ..... 52/63
2,162,523 A * 6/1939 Blood et al. ..... 312/210
3,526,066 A * 9/1970 Gamble et al. ..... 52/27
3,534,512 A * 10/1970 Ballas ..... 52/67
3,589,525 A * 6/1971 Allen ..... 211/162
3,629,982 A * 12/1971 Ballay et al. ..... 52/69
3,984,949 A * 10/1976 Wahlquist ..... 52/70
4,037,385 A * 7/1977 Wahlquist ..... 52/745.02
4,829,726 A * 5/1989 de Potter d'Indoye ..... 52/66
5,167,575 A * 12/1992 MacDonald ..... 454/187
5,371,982 A * 12/1994 Douglas et al. ..... 52/64
6,151,852 A * 11/2000 Linn et al. ..... 52/239
6,296,038 B1 * 10/2001 Chen ..... 160/199
6,598,355 B2 * 7/2003 Owens ..... 52/71
8,074,699 B2 * 12/2011 Jones et al. ..... 160/206
8,215,065 B2 * 7/2012 Gallant ..... 52/36.1
2002/0023392 A1 * 2/2002 Bischof ..... 52/64
2008/0244991 A1 * 10/2008 Coleman et al. ..... 52/71

* cited by examiner

*Primary Examiner* — Ryan Kwiecinski

(57) ABSTRACT

An extendable backdrop erecting device, comprising: a fixed wall disposed at one end of a space and having a fixed backdrop surface that faces away from the one end of the space, two lateral ends of the fixed wall being each provided with a first pivot; a movable wall disposed beside the fixed wall and having a first movable backdrop surface corresponding to the fixed backdrop surface, two lateral ends of the movable wall being each provided with a second pivot; and two extendable and foldable walls pivoted between the first pivots and the second pivots respectively and each having a respective foldable backdrop surface, wherein the movable wall can move to the other end of the space as the foldable walls extend so that the fixed backdrop surface, the first movable backdrop surface and the foldable backdrop surfaces are located around the space to increase the convenience in use.

5 Claims, 6 Drawing Sheets

EXTENDABLE BACKDROP ERECTING DEVICE

BACKGROUND OF THE INVENTION

1. Technical Field

The present invention provides an extendable backdrop erecting device, and particularly relates to a device capable of extendably erecting a backdrop on inner walls of an indoor space or in an outdoor space and, more particularly, to a fixed wall, a movable wall and foldable walls of the backdrop as well as pivots and backdrop surfaces of the fixed wall, the movable wall and the foldable walls.

2. Description of Related Art

Suitable indoor and outdoor backdrops can not only beautify the living environment, but can also relax people and create a comfortable atmosphere. Therefore, the indoor and outdoor backdrops are indispensible to indoor and outdoor activity spaces such as general homes, schools and offices.

As is known, an indoor backdrop comprises arrangement of inner walls of an indoor space such as surrounding wall surfaces and a ceiling, and an outdoor backdrop comprises arrangement of outer walls of a building such as outdoor wall surfaces and a ceiling of an eave. The backdrops are usually formed by coating the wall surfaces and the ceilings with a paint of a particular color, pattern or design, or by affixing wallpaper of a particular color, pattern or design to the wall surfaces and the ceilings, or by disposing wood tiles on the wall surfaces and the ceilings.

However, the conventional backdrop arranged on the wall surfaces of the indoor or outdoor space cannot be replaced and changed at will. Now, there is a practice of arbitrarily changing a backdrop, which is achieved by deploying a guide rail on the ground of the indoor or outdoor space and slidably disposing a plurality of partitions on the guide rail so that the single space is divided by the partitions into a plurality of independent spaces.

However, the shortcoming of this practice is that, the partitions are mainly used to divide the space and can only cause extension and retraction of a part of the space in terms of variations of the backdrop. Therefore, a need exists in the art to solve the aforesaid problem.

BRIEF SUMMARY OF THE INVENTION

An objective of the present invention is to provide a backdrop device extendably erected on inner walls of an indoor space so as to overcome the problems with the prior art that the conventional indoor backdrop arranged on inner walls of an indoor space cannot be replaced and changed at will and that using the partitions can only cause extension and retraction of a part of the indoor space in terms of variations.

To achieve the aforesaid objective, the present invention provides an extendable backdrop erecting device, which comprises:

a fixed wall located at one end of a space, two lateral ends of the fixed wall being each provided with a first pivot, and the fixed wall having a fixed backdrop surface that faces away from the one end of the space;

a movable wall disposed beside the fixed wall, two lateral ends of the movable wall being each provided with a second pivot, and the movable wall having a first movable backdrop surface corresponding to the fixed backdrop surface; and two foldable walls pivoted between the first pivots and the second pivots respectively, each of the foldable walls being formed by a plurality of foldable sub-walls pivoted together to make the foldable wall extendable and foldable, the foldable walls each having a respective foldable backdrop surface, and the movable wall being adapted to move to the other end of the space as the foldable walls extend so that the fixed backdrop surface, the first movable backdrop surface and the foldable backdrop surfaces are located around the space.

Through what described above, the movable wall can move between the two ends of the space as the foldable walls extend and retract. When the movable wall moves to the one end of the space, wall surfaces of the space can provide a first wall-surface backdrop; and when the movable wall moves to the other end of the space, the fixed backdrop surface, the first movable backdrop surface and the foldable backdrop surfaces move to the inner walls of the space respectively to provide a second wall-surface backdrop.

Accordingly, the fixed wall, the movable wall and the foldable walls can be extendably erected on wall surfaces of an indoor or outdoor space so that the indoor or outdoor backdrop can be replaced at will to increase the convenience in use.

In practice, the space may be an indoor space or an outdoor space, and at least one piece of extendable furniture is disposed on the fixed backdrop surface, the first movable backdrop surface or either of the foldable backdrop surfaces.

In an embodiment, the movable wall has a second movable backdrop surface that faces away from the one end of the space; and at least one piece of extendable furniture is disposed on the second movable backdrop surface.

In another embodiment, the space is provided with a guide rail at two sides respectively, the two guide rails are parallel with each other, and the second pivots each have an end slidably disposed on a corresponding one of the guide rails; and any two adjacent ones of the foldable sub-walls are pivoted together via a third pivot which has an end slidably disposed on a corresponding one of the guide rails.

In a further embodiment, the present invention further comprises at least one access opening formed in the fixed wall, the movable wall or either of the foldable walls; and the at least one access opening corresponds to an access of the space.

Furthermore, the present invention further comprises at least one backdrop window that is formed in the fixed wall, the movable wall or either of the foldable walls and corresponds to a window of the space.

DETAILED DESCRIPTION OF THE INVENTION

Figure 1:
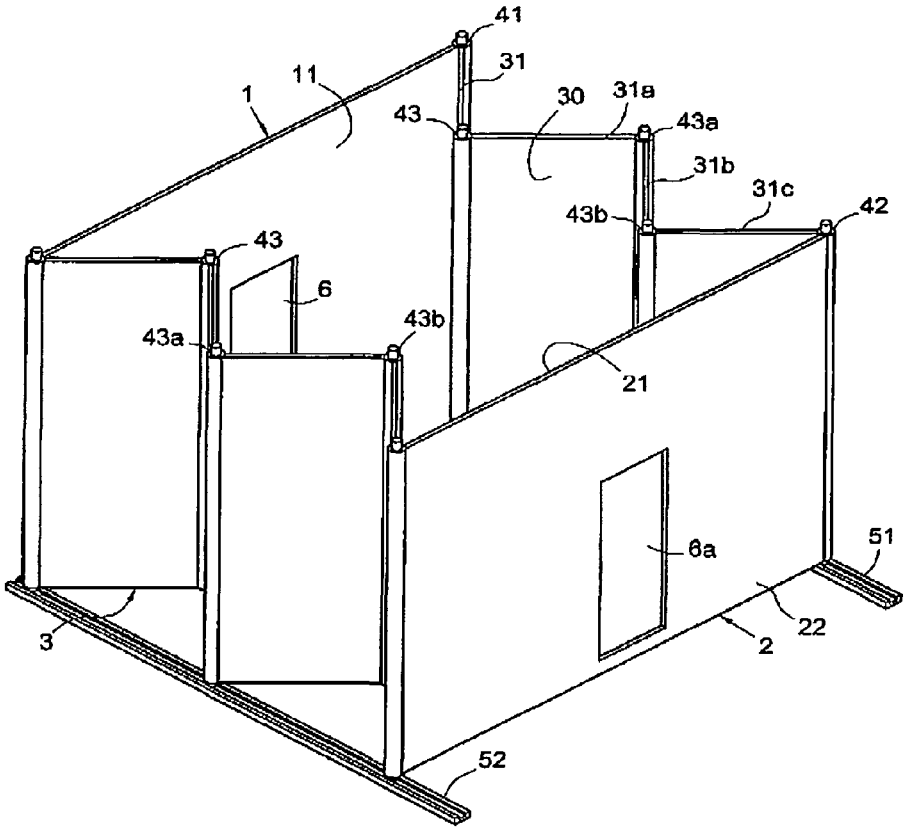
FIG. 1 is a perspective view of a first embodiment of the present invention.
Figure 2:
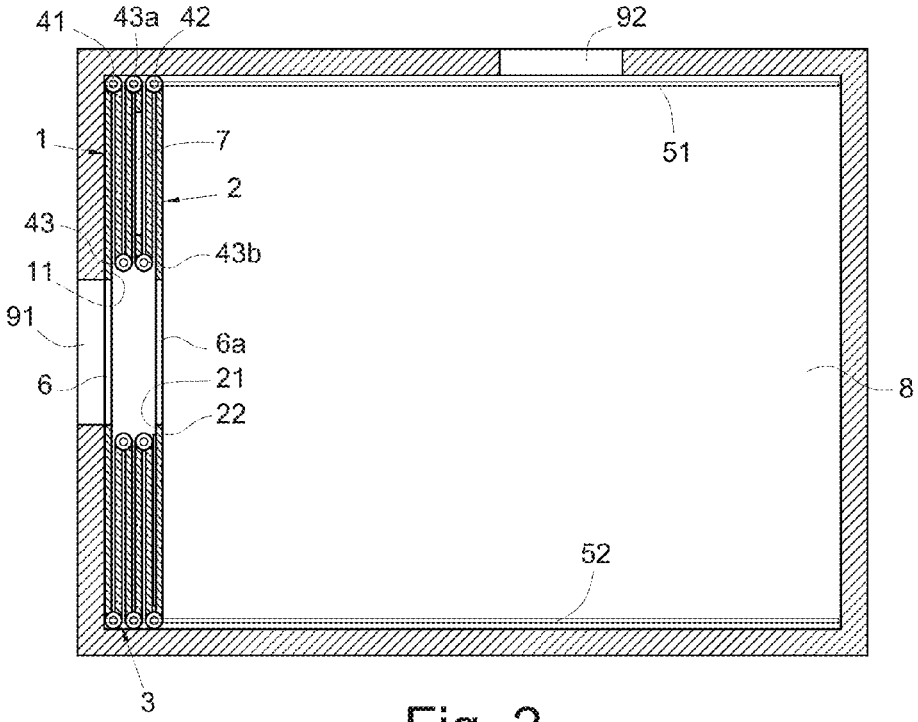
FIG. 2 is a cross-sectional top view of the embodiment of FIG. 1.
Figure 3:
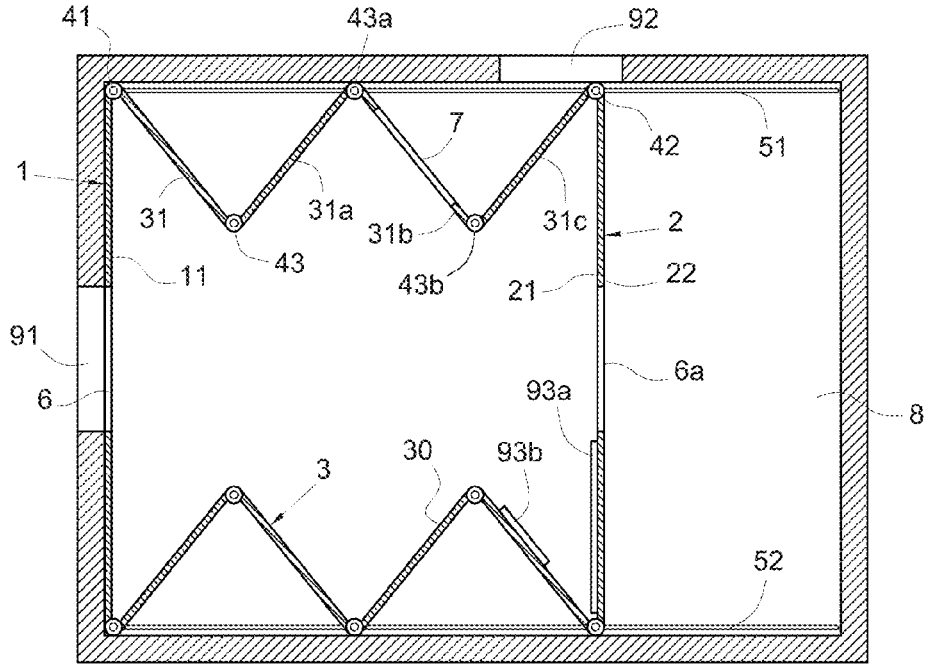
FIG. 3 is a cross-sectional top view illustrating a use status of FIG. 2.
Figure 4:
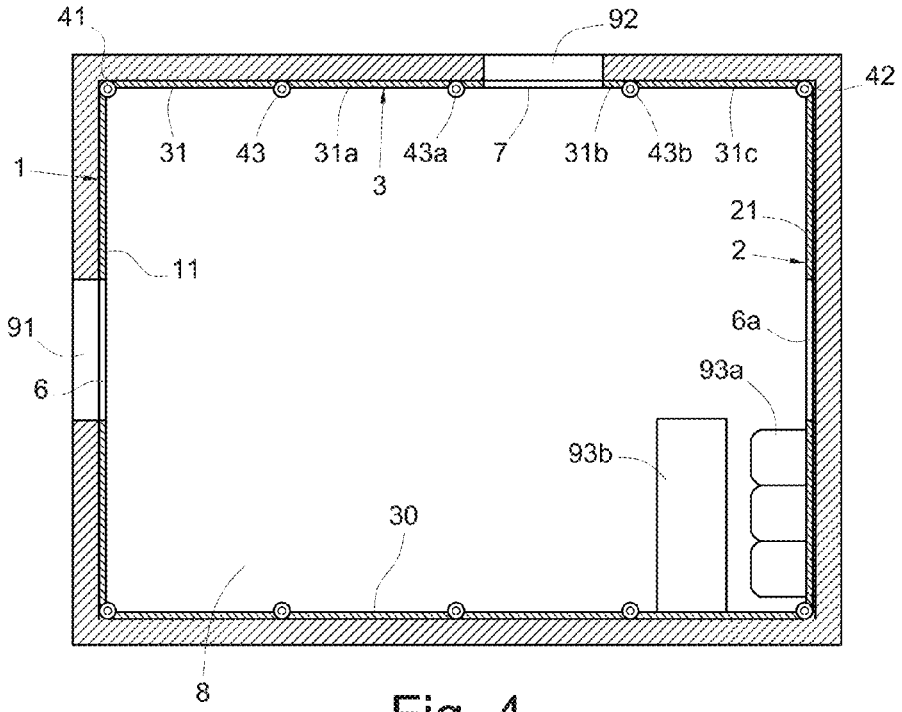
FIG. 4 is a cross-sectional top view illustrating another use status of FIG. 2.

Referring to FIG. 1, there is shown a perspective view of a first embodiment of the present invention; and referring to FIG. 2 to FIG. 4 together, an extendable backdrop erecting device of the present invention comprises a fixed wall 1, a movable wall 2 and two foldable walls 3.

The fixed wall 1 is in a rectangular form, and is vertically located on a wall surface at one end of a space 8. Two lateral ends of the fixed wall 1 are each provided with a vertical first pivot 41. The fixed wall 1 has a fixed backdrop surface 11 that faces away from the one end of the space 8, and the fixed backdrop surface 11 has a particular color, pattern or design.

The space 8 may be an indoor space 8 such as a home, a school or an office in this embodiment. The fixed wall 1 is disposed between the first pivots 41, with the fixed backdrop surface 11 facing towards a wall surface at the other end of the indoor space 8.

The movable wall 2 is in a rectangular form, and is vertically and movably disposed beside the fixed wall 1 and parallel with the fixed wall 1. Two lateral ends of the movable wall 2 are each provided with a vertical second pivot 42. The movable wall 2 has a first movable backdrop surface 21 corresponding to the fixed backdrop surface 11, and a second movable backdrop surface 22 that faces away from the one end of the indoor space 8. The first movable backdrop surface 21 and the second movable backdrop surface 22 each have a particular color, pattern or design. The movable wall 2 is disposed between the second pivots 42, with the first movable backdrop surface 21 facing towards the fixed backdrop surface 11.

Figure 10:
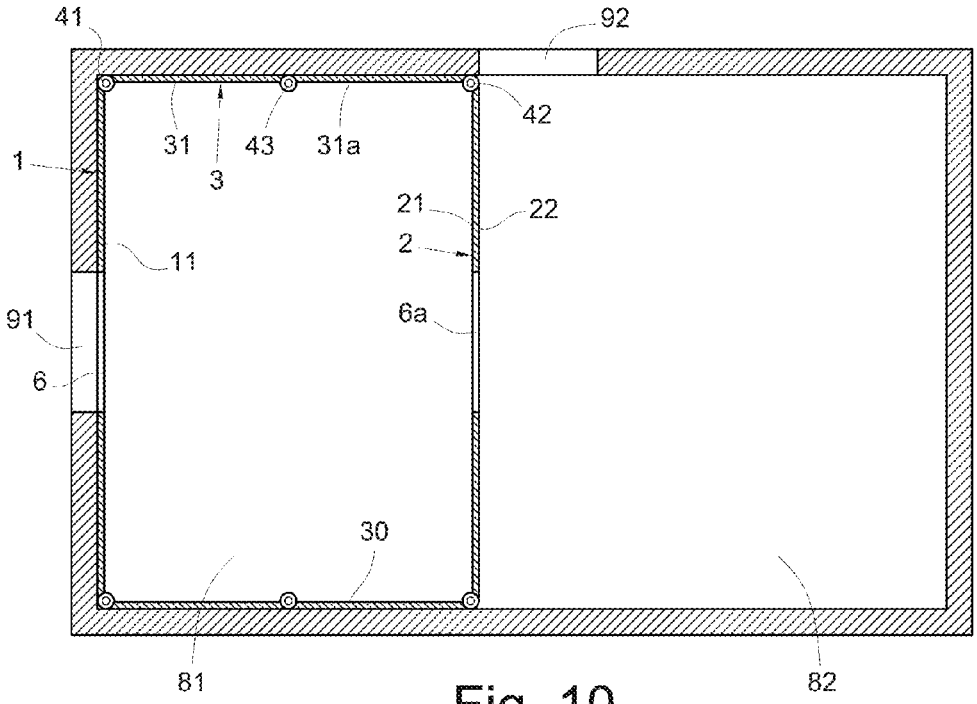
FIG. 10 is a cross-sectional top view of a sixth embodiment of the present invention.

The foldable walls 3 are each in a rectangular form, and are pivoted between the first pivots 41 and the second pivots 42 respectively. Each of the foldable walls is formed by a plurality of rectangular foldable sub-walls 31 pivoted together to make the foldable wall 3 extendable and foldable in a horizontal direction, and any two adjacent ones of the foldable sub-walls 31 are pivoted together via a vertical third pivot 43. There are at least two foldable sub-walls 31, 31*a* for each of the foldable walls 3 (as shown in FIG. 10), and the foldable sub-walls 31, 31*a* can swing with respect to each other to overlap or extend.

In this embodiment, four foldable sub-walls 31, 31*a*, 31*b*, 31*c* for each of the foldable walls 3 will be illustrated as an example. In this example, the foldable sub-walls 31, 31*a*, 31*b*, 31*c* can be arranged as one piece in the horizontal direction; adjacent lateral ends of the foldable sub-walls 31, 31*a* are pivoted together via the third pivot 43; adjacent lateral ends of the foldable sub-walls 31*a*, 31*b* are pivoted together via the third pivot 43*a*; and adjacent lateral ends of the foldable sub-walls 31*b*, 31*c* are pivoted together via the third pivot 43*b*.

Adjacent lateral ends of each of the foldable sub-walls 31 and the fixed wall 1 are pivoted together via a corresponding one of the first pivots 41, and adjacent lateral ends of each of the foldable sub-walls 31*c* and the movable wall 2 are pivoted together via a corresponding one of the second pivots 42. Thereby, each of the foldable walls 3 is foldable and extendable.

The foldable walls 3 each have a respective foldable backdrop surface 30 of a particular color, pattern or design. The movable wall 2 is capable of moving to the other end of the indoor space 8 as the foldable walls 3 extend so that the fixed backdrop surface 11, the first movable backdrop surface 21 and the foldable backdrop surfaces 30 are located on inner walls around the indoor space 8.

In a more specific embodiment, the present invention also comprises the following features.

The fixed wall 1, the movable wall 2 and the foldable walls 3 may be made of wood, and may also be made of light materials such as cardboards, curtains, rubber films and Styrofoam boards. The first, the second and the third pivots 41, 42, 43, 43*a*, 43*b* may be made of light materials such as aluminum extrusions and stainless steel.

Guide rails 51, 52 parallel with each other are disposed on the ground at two sides of the indoor space 8 respectively, and bottom ends of the second pivots 42 and the third pivots 43*a* are slidably disposed on the guide rails 51, 52 respectively to be guided by the guide rails 51, 52 so as to increase the movement stability of the foldable walls 3 when folding and extending.

The present invention further comprises at least one opening 6 through which a user can go out and in, and the at least one opening 6 is formed in the fixed wall 1, the movable wall 2 or either of the foldable walls 3. In this embodiment, the fixed wall 1 may be disposed on a wall surface in which an access 91 of the indoor space 8 is formed; there may be two openings 6, 6*a*, which are formed in the fixed wall 1 and the movable wall 2 respectively and extend through the fixed backdrop surface 11 and the first and the second movable backdrop surfaces 21, 22 respectively; and the openings 6, 6*a* correspond to the access 91 of the indoor space 8.

Furthermore, the present invention further comprises at least one backdrop window 7, which is formed in the fixed wall 1, the movable wall 2 or either of the foldable walls 3 and corresponds to an indoor window 92 of the indoor space 8. In this embodiment, the at least one backdrop window 7 may be formed in the foldable sub-wall 31*b* of one of the foldable walls 3 and extends through the corresponding foldable backdrop surface 30.

Through the aforesaid components, the user may move the movable wall 2 towards the one end of the indoor space 8 (as shown in FIG. 2) so that the foldable sub-walls 31, 31*a*, 31*b*, 31*c* overlap with each other and the movable wall 2 is located at the one end of the indoor space 8. Meanwhile, the second movable backdrop surface 22 of the movable wall 2 is displayed in the indoor space 8, and combines with the inner walls of the indoor space 8 to forma first wall-surface backdrop. Moreover, the opening 6*a* in the second movable backdrop surface 22 just corresponds to the access 91, so the user can go into and out of the indoor space 8 through the opening 6*a* in the second movable backdrop surface 22 and the access 91.

The user may also arbitrarily move the movable wall 2 towards the other end of the indoor space 8 (as shown in FIG. 3 and FIG. 4) so that the foldable sub-walls 31, 31*a*, 31*b*, 31*c* extend, and the movable wall 2 moves to the wall surface at the other end of the indoor space 8 as the foldable walls 3 extend. In this process, the second pivots 42 and the third pivots 43*a* are guided by the guide rails 51, 52 so that the movable wall 2 and the foldable walls 3 move stably, and the user can move around the fixed wall 1, the movable wall 2 and the indoor space 8 through the opening 6*a* in the movable wall 2. Meanwhile, the fixed wall 1, the movable wall 2 and the foldable walls move to the inner walls around the indoor space 8 respectively so that the fixed backdrop surface 11, the first movable backdrop surface 21 and the foldable backdrop surfaces 30 are displayed in the indoor space 8 respectively to form a second wall-surface backdrop. The opening 6 in the fixed backdrop surface 11 just corresponds to the access 91, and the backdrop window 7 in one of the foldable backdrop surfaces 30 just corresponds to the indoor window 92. Thereby, the user can go into and out of the indoor space 8 through the opening 6 in the fixed backdrop surface 11 and the access 91, and can view the outside through the backdrop window 7 in the foldable backdrop surface 30.

Through what described above, the movable wall 2 can move between the two ends of the space 8 as the foldable walls 3 extend and retract. When the movable wall 2 moves to the one end of the space 8, the wall surfaces of the space 8 can provide the first wall-surface backdrop. When the movable wall 2 moves to the other end of the space 8, the fixed backdrop surface 11, the first movable backdrop surface 21 and the foldable backdrop surfaces 30 move to the four sides of the space 8 respectively to provide the second wall-surface backdrop.

Accordingly, the fixed wall 1, the movable wall 2 and the foldable walls 3 can be extendably erected on the wall surfaces of the indoor or outdoor space 8 so that the indoor or outdoor backdrop can be replaced at will. Thereby, the problems with the prior art that the conventional indoor backdrop arranged on inner walls of an indoor space cannot be replaced and changed at will and that using the partitions can only cause extension and retraction of a part of the indoor space in terms of variations are overcome, and the convenience in use is increased.

Figure 5:
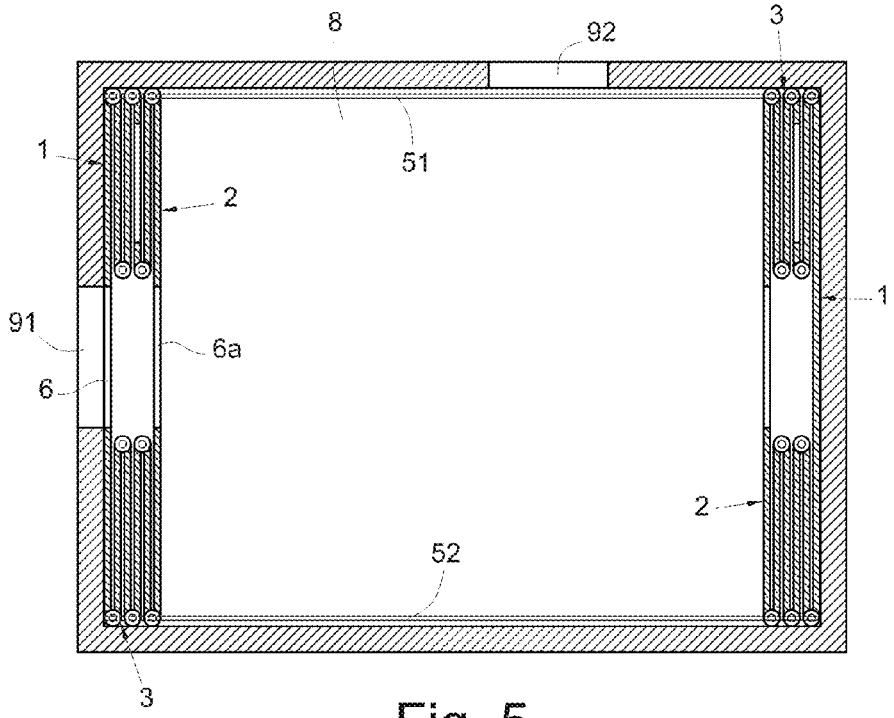
FIG. 5 is a cross-sectional top view of a second embodiment of the present invention.

Referring to FIG. 5, there is shown a cross-sectional top view of a second embodiment of the present invention. In this embodiment, there may also be two groups each comprising a fixed wall 1, a movable wall 2 and two foldable walls 3, and the two groups are arranged at the two ends of the indoor space 8 respectively. The other components and implementations are the same as those in the first embodiment. In this way, a third indoor backdrop can be provided in the indoor space 8.

Figure 6:
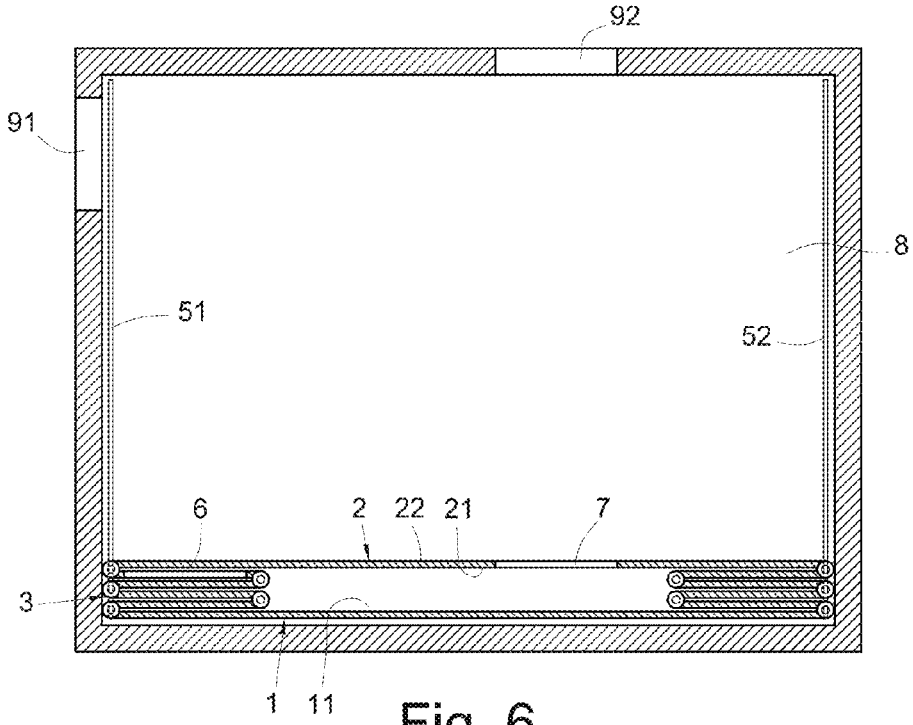
FIG. 6 is a cross-sectional top view of a third embodiment of the present invention.
Figure 7:
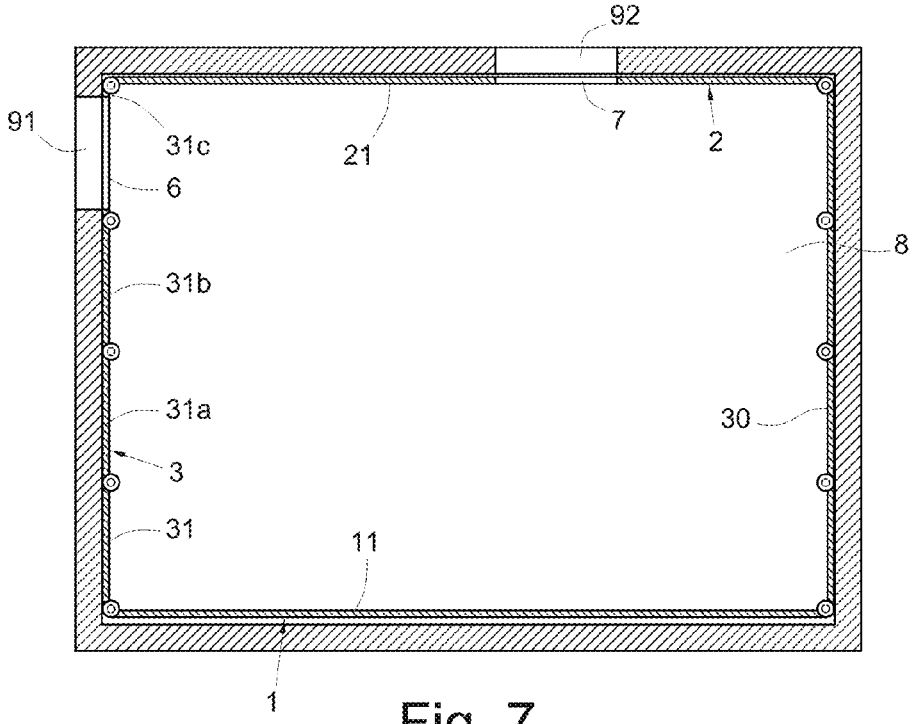
FIG. 7 is a cross-sectional top view illustrating a use status of FIG. 6.

Referring to FIG. 6, there is shown a cross-sectional top view of a third embodiment of the present invention. In this embodiment, the fixed wall 1 may also be disposed on a wall surface of the indoor space 8 in which the access 91 is not formed; the opening 6 is formed in the foldable sub-wall 31*c* of one of the foldable walls 3, and can correspond to the access 91 when the foldable wall 3 extends (as shown in FIG. 7); and the backdrop window 7 is formed in the movable wall 2 and corresponds to the indoor window 92. The other components and implementations are the same as those in the first embodiment.

Figure 8:
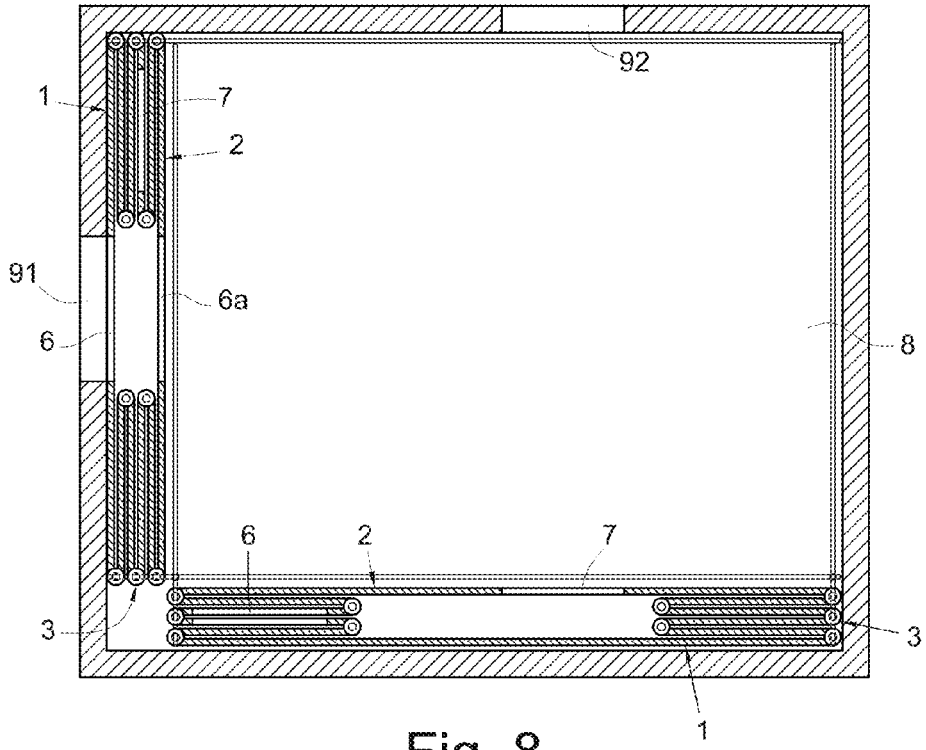
FIG. 8 is a cross-sectional top view of a fourth embodiment of the present invention.

Referring to FIG. 8, there is shown a cross-sectional top view of a fourth embodiment of the present invention. In this embodiment, there may be two groups each comprising a fixed wall 1, a movable wall 2 and two foldable walls 3; and the fixed walls 1 may be respectively disposed on a wall surface of the indoor space 8 in which the access 91 is formed and a wall surface of the indoor space 8 in which the access 91 is not formed. The other components and implementations are the same as those in the aforesaid embodiments. In this way, a third indoor backdrop can be provided in the indoor space 8.

Figure 9:
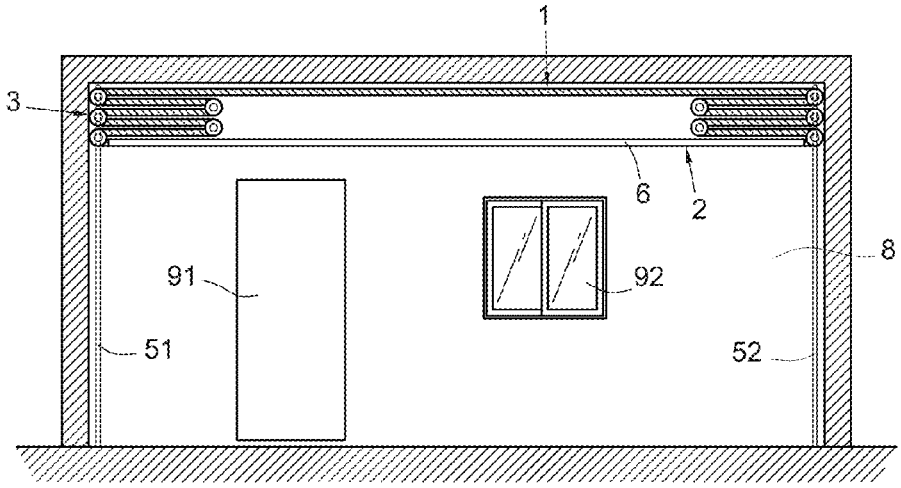
FIG. 9 is a cross-sectional front view of a fifth embodiment of the present invention.

Referring to FIG. 9, there is shown a cross-sectional front view of a fifth embodiment of the present invention. In this embodiment, the fixed wall 1, the movable wall 2 and the foldable walls 3 may also be disposed on a ceiling of the indoor space 8 so that the movable wall 2 and the foldable walls 3 are extendable and foldable in a vertical direction; and the opening 6 and the backdrop window 7 may be formed in the fixed wall 1, the movable wall 2 or either of the foldable walls 3 according to the positions of the access 91 and the indoor window 92. The other components and implementations are the same as those in the aforesaid embodiments.

Referring to FIG. 10, there is shown a cross-sectional top view of a sixth embodiment of the present invention. In this embodiment, the movable wall 2 moves towards the other end of the indoor space 8 as the two foldable sub-walls 31, 31*a* of each of the foldable walls 3 extend; and the movable wall 2 does not move to the wall surface at the other end of the indoor space 8 so that the indoor space 8 is divided by the movable wall 2 into a first movable region 81 located between the fixed wall 1, the movable wall 2 and the foldable walls 3 and a second movable region 82 located between the movable wall 2 and the wall surface at the other end of the indoor space 8. The fixed backdrop surface 11, the first movable backdrop surface 21 and the foldable backdrop surfaces are displayed in the first movable region 81 respectively to form the second wall-surface backdrop; and the second movable backdrop surface 22 combines with the inner walls of the indoor space 8 to form the first wall-surface backdrop. In this way, the present invention can not only partition the space, but can also provide different wall-surface backdrops respectively.

Furthermore, at least one piece of extendable furniture 93*a*, 93*b* (as shown in FIG. 3 and FIG. 4) is disposed on the fixed backdrop surface 11, the first movable backdrop surface 21, the second movable backdrop surface 22 or either of the foldable backdrop surfaces 30. The extendable furniture 93*a*, 93*b* may be chairs, tables or cupboards. After the movable wall 2 moves to the other end of the space 8 so that the fixed backdrop surface 11, the first movable backdrop surface 21 and the foldable backdrop surfaces 30 move to the four sides of the space 8 respectively, the extendable furniture 93*a*, 93*b* can extend for use by people.

In addition to this, the space 8 may also be an outdoor space; and in this case, the fixed wall 1 is located on a wall surface at one end of the outdoor space. The other components and implementations are the same as those in the aforesaid embodiments.

What is claimed is:

1. An extendable backdrop erecting device, comprising:

a space for housing the device, the space have a perimeter formed by a first end wall and a second end wall spaced and parallel with the first end wall, and a first sidewall and a second sidewall spaced and parallel with the first sidewall;

a fixed backdrop wall, having a first and second lateral end, located directly adjacent the first end wall, each of the first and second lateral ends provided with a first pivot, said fixed backdrop wall having a backdrop surface that faces away toward an interior of the space, away from the first end wall;

a movable wall disposed beside the fixed backdrop wall when in a retracted position, said movable wall having a third and fourth lateral end, each of the third and fourth lateral ends provided with a second pivot, the movable wall having a first movable surface facing the fixed wall corresponding to the backdrop surface and a second movable surface facing away from the fixed wall corresponding to the backdrop of the space;

a first foldable wall and a second foldable wall pivoted between the first pivots and the second pivots, respectively, each of the first and second foldable walls being formed from a plurality of sub-walls pivoted together to enable the foldable walls to be in an extended position and the retracted position, the first and second foldable walls each having a first foldable wall surface corresponding to the backdrop surface facing the interior of the space when in the extended position, said space having a guide rail located on a floor adjacent each of the first and second sidewalls, the guiderails being parallel one another, wherein each of the second pivots have an end slidably disposed on a corresponding one of the guide rails, wherein the second pivots travel along the guide rails between the extended and retracted position, at least one access opening formed in one of the fixed backdrop wall, the movable wall, the first foldable wall, or the second foldable wall, said at least one access opening corresponds to an access opening in the corresponding one of the first end wall, second end wall, first sidewall or second sidewall when the device is in the extended position;

at least one backdrop window formed in one of the fixed backdrop wall, the movable wall, the first foldable wall, or the second foldable wall, said at least one backdrop window corresponds to a window in the corresponding one of the first end wall, second end wall, first sidewall or second sidewall when the device is in the extended position;

wherein when the extendable backdrop erecting device is in the extended position, the extendable backdrop devices extends around the perimeter of the space.

2. The extendable backdrop erecting device of claim 1, wherein the space is an indoor space or an outdoor space.

3. The extendable backdrop erecting device of claim 1, wherein at least one piece of extendable furniture is disposed on the backdrop surface, the first movable surface, or either of the first foldable wall surfaces.

4. The extendable backdrop erecting device of claim 1, wherein at least one piece of extendable furniture is disposed on the second movable surface.

5. The extendable backdrop erecting device of claim 1, wherein two adjacent sub-walls of the first and second foldable walls are pivoted together via a third pivot which has an end slidably disposed on a corresponding one of the guide rails.

* * * * *